United States Patent [19]

Newsom

[11] 4,092,625

[45] May 30, 1978

[54] SINGLE USE MONITORS FOR AUTOMATIC SAFETY CONTROLS OF ELECTRICALLY ENERGIZED APPARATUS

[75] Inventor: C. Fred Newsom, Kenner, La.

[73] Assignee: Tattle-Tale, Inc., New Orleans, La.

[21] Appl. No.: 704,865

[22] Filed: Jul. 12, 1976

[51] Int. Cl.[2] ..... H01H 37/76

[52] U.S. Cl. ..... 337/405; 337/416; 116/114.5; 340/256

[58] Field of Search ..... 337/401, 403, 405, 407, 337/414–416; 340/253 P, 256; 116/114.5

[56] References Cited

U.S. PATENT DOCUMENTS

| | | | |
|---|---|---|---|
| 2,712,575 | 7/1955 | Kiel | 337/414 X |
| 2,790,877 | 4/1957 | Evans et al. | 337/414 X |
| 3,118,994 | 1/1964 | Kabik | 337/401 |
| 3,948,143 | 4/1976 | Olsen | 337/416 X |

*Primary Examiner*—George Harris
*Attorney, Agent, or Firm*—James B. Lake, Jr.

[57] ABSTRACT

A tungsten heating filament is connected in series with a safety filament having a low melting temperature. The filaments are connected to and between terminals of a small terminal board. A quickly-igniting, combustible mixture is applied to the terminal board between terminals, and over and around the heating filament and under the safety filament. The terminal board and its attachments are enclosed in a plastic case with a transparent face. Leads are connected internally to the terminals and externally in parallel circuit across a safety switch operable to open and close by means of a malfunction sensing element, the switch and element comprising an automated safety control, with the switch being connected in series with the electrically energized apparatus. The opening of a safety switch energizes the filaments to ignite the combustible mixture causing discoloration, and to melt the safety filament breaking the filament circuit and preventing energization of the apparatus before automated safety control reset.

2 Claims, 2 Drawing Figures

SINGLE USE MONITORS FOR AUTOMATIC SAFETY CONTROLS OF ELECTRICALLY ENERGIZED APPARATUS

SUMMARY OF THE INVENTION

The invention relates generally to monitoring devices, and more particularly to a single use monitor for determining which, if any, of a plurality of automated safety controls had been activated during operation of an electrical apparatus.

Automated safety controls for electrically energized apparatus usually comprise safety switches connected in series with an operating switch for normal use in turning the electrical apparatus on and off. Each safety switch is operable by its sensing and activating elements to open for sensed malfunctions in its protected area and to reset when and if the malfunctions abate. In sophisticated apparatus there are usually a plurality of safety controls each protecting a particular area of operation. Thus an air conditioner may have protective areas in temperature, pressure, and electrical current and voltage, and an apparatus shutdown may result in any or all of these areas. Such shutdown could be self-abating before a trouble-shooter could arrive on the scene and leave the area of the malfunction unidentified. The monitors of the invention will clearly indicate the areas of malfunctions, regardless of subsequent abatement, for more accurate and timely location and correction.

An object of the invention is to provide a monitor for each of the safety controls of an electrical apparatus.

Another of the objects of the invention is to provide means for monitoring a safety control without disabling it or the apparatus monitored.

Other objects and a fuller understanding of the invention may be had by referring to the following description and claims taken together with a view of the accompanying drawings as described below.

DETAILED DESCRIPTION OF THE PREFERRED EMBODIMENT

Figure 1:
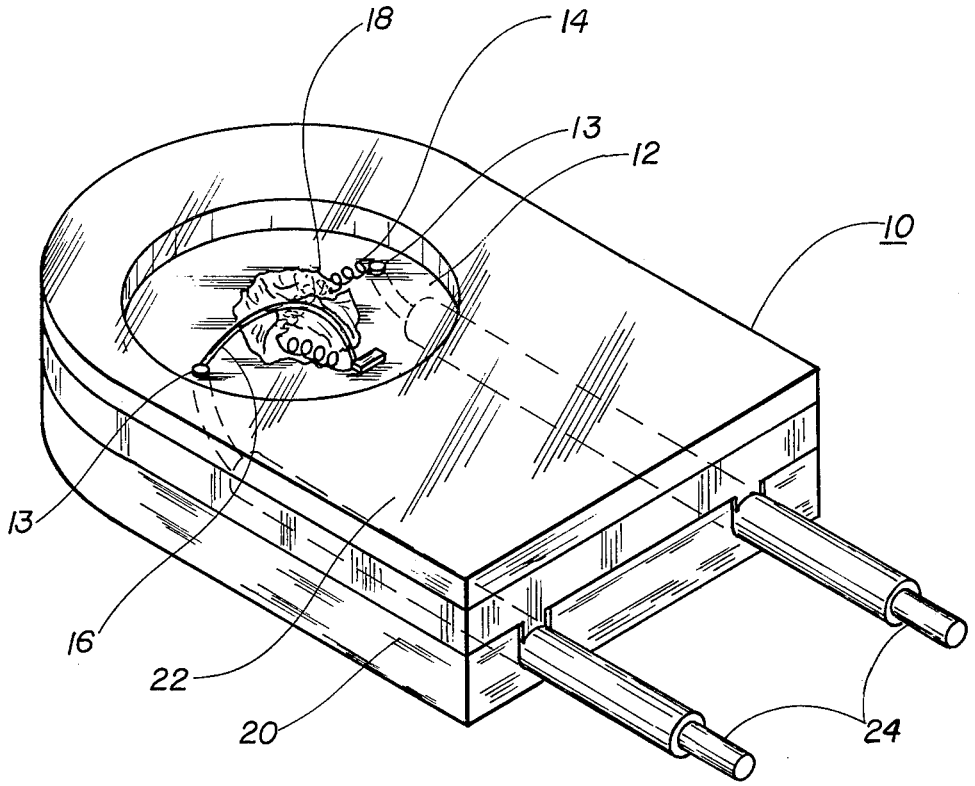
FIG. 1 is a three dimensional view of the invention.
Figure 2:
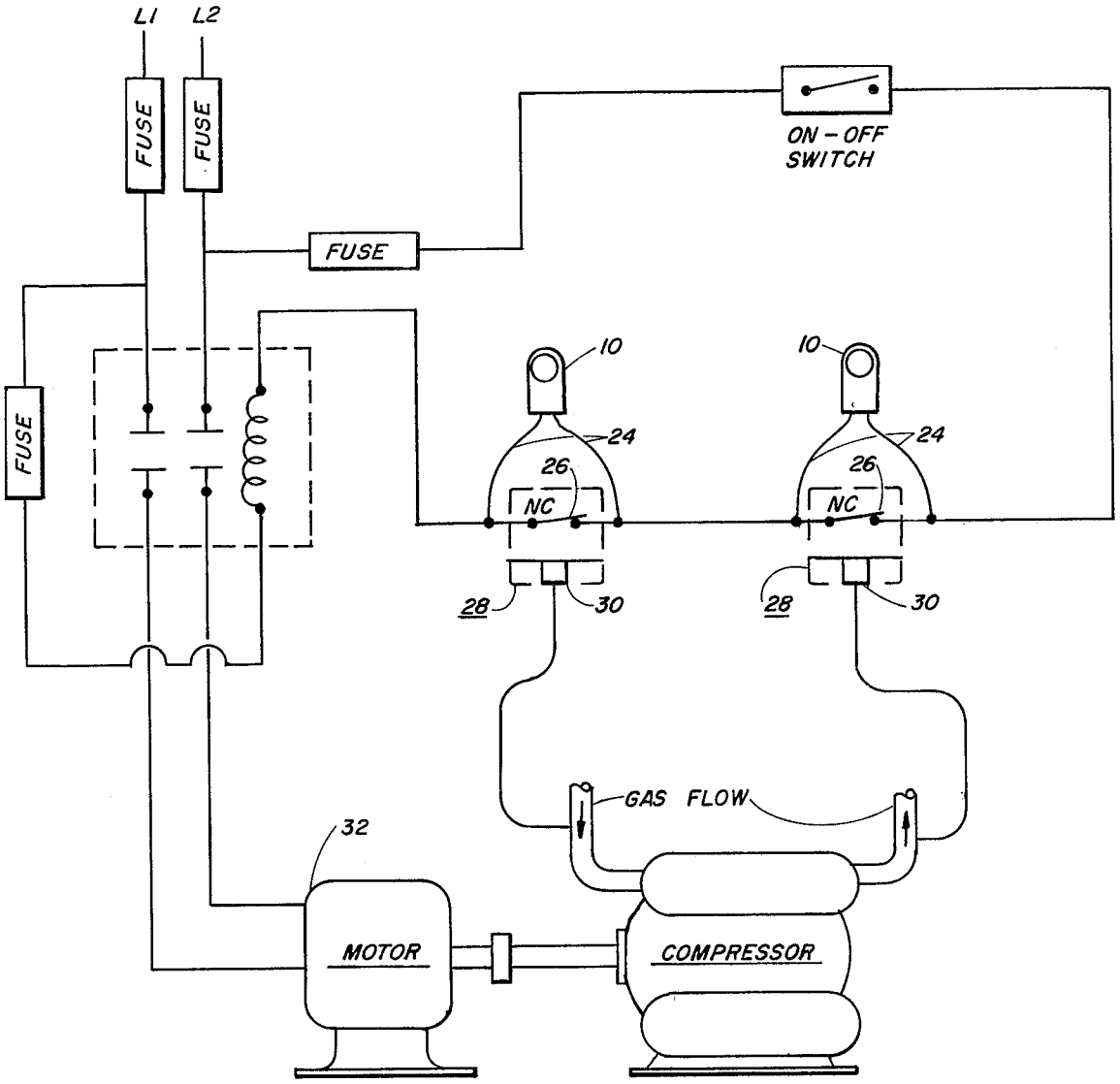
FIG. 2 is a diagramatic sketch of the invention connected in the energizing circuit of an electrical apparatus.

Referring to FIGS. 1 and 2, the invention, a thermoelectric monitor 10, comprises a small non-ignitable terminal board 12 having terminals 13 across which are connected in series a tungsten heating filament 14 and a safety filament 16 having a low melting point of about 450 degrees Fahrenheit or 232 Celcius. A quickly ignitable and combustible mixture 18 that is liquid in application and hardens quickly thereafter is applied to the terminal board 12 and between terminals 13 with the heating filament 14 passing through mixture 18 and safety filament 16 passing over it. The composition of matchheads has been found satisfactory for use as mixture 18 and comprises antimony trisulfide, glue and an oxidizing agent, usually potassium chlorate.

Terminal board 12 and its attachments are enclosed in a non-combustible plastic case 20 with a transparent face 22. Leads 24 are interiorly connected respectively to terminals 13 and pass out of case 20 for connecting the device 10 in parallel across a safety switch 26 of an automated safety control 28 having a malfunction sensing element 30 adapted to open and close said switch 26 in case of malfunction and the abatement thereof, respectively.

Tungsten heating filament 14 must have a sufficiently high resistance to make a voltage drop across both filaments negligible when safety switch 26 is closed. Resistances of 90, 200, and 400 ohms have been found acceptable for voltages of 24, 115, and 230 volts respectively. The combustible mixture can be color coded to display the respective values through transparent face 22 of the enclosing plastic case 20.

In use, monitor 10 is connected as shown in FIG. 2 in an electrically energized apparatus 32. When safety switch 26 is opened by its sensing element 30, electrical energizing supply is shunted through the filament circuits connected in parallel across switch 26. Filament 14 becomes hot to ignite mixture 18 which burns to melt filament 16 and break the filament parallel circuit. In burning the terminal board 12 and mixture 18 is discolored to indicate through transparent face 22 that switch 26 has opened. Breaking the filament circuit prevents energizing apparatus 32 through the filaments but does not interfere with sensing element resetting switch 26.

What is claimed is:

1. In an electrically energized apparatus, having a normally closed safety switch connected in series in an energizing circuit thereto and automatically operable by a sensing element adapted to sense a malfunction in a part of said apparatus, a single-use monitor for indicating an opening of said safety switch by said sensing element and comprising in combination:

a. high resistance heating means connected in parallel with said normally closed safety switch for breaking said energizing circuit when said safety switch is opened, and remaining connected in parallel in said energizing circuit when said safety switch remains normally closed.

b. case means enclosing said high resistance electrical heating means and being adapted to visually display evidence of the breaking of said energizing circuit, for indicating a malfunction had occurred at the site of said sensing element.

2. A monitor as described in claim 1 wherein said heating means comprises: a heating filament having an electrical resistance of approximately two ohms per volt of said energizing circuit for providing a negligible voltage drop and heating when said safety switch is closed, and for a large voltage drop and heating thereof when said safety switch is open; a safety filament, having a low melting temperature, connected in series to said heating filament; and a quick igniting combustible mixture applied to the interior of said case means adjacent to said filaments, and ignitable by said heating filament only when said safety switch opens for melting said safety filament.

* * * * *